US010087726B2

(12) United States Patent
Boisvert et al.

(10) Patent No.: US 10,087,726 B2
(45) Date of Patent: Oct. 2, 2018

(54) SYSTEM AND METHOD FOR ROTATING CASING STRING

(71) Applicant: SEABOARD INTERNATIONAL, INC., Houston, TX (US)

(72) Inventors: Loren P. Boisvert, Katy, TX (US); Charles Chapman, Houston, TX (US)

(73) Assignee: SEABOARD INTERNATIONAL, INC., Houston, TX (US)

( * ) Notice: Subject to any disclaimer, the term of this patent is extended or adjusted under 35 U.S.C. 154(b) by 0 days.

(21) Appl. No.: 15/464,893

(22) Filed: Mar. 21, 2017

(65) Prior Publication Data

US 2017/0191353 A1 Jul. 6, 2017

Related U.S. Application Data

(63) Continuation of application No. 14/250,111, filed on Apr. 10, 2014, now Pat. No. 9,605,503.

(60) Provisional application No. 61/811,523, filed on Apr. 12, 2013.

(51) Int. Cl.

| | |
|---|---|
| ***E21B 17/02*** | (2006.01) |
| ***E21B 17/05*** | (2006.01) |
| ***E21B 19/16*** | (2006.01) |
| ***E21B 43/10*** | (2006.01) |

(52) U.S. Cl.

CPC ..... *E21B 43/10* (2013.01); *E21B 17/05* (2013.01)

(58) Field of Classification Search

CPC ..... E21B 17/02; E21B 19/16; E21B 33/0415; E21B 17/05

See application file for complete search history.

(56) References Cited

U.S. PATENT DOCUMENTS

| | | | |
|---|---|---|---|
| 2,693,238 | A | 11/1954 | Baker |
| 2,893,694 | A | 7/1959 | Waggener |
| 3,623,753 | A | 11/1971 | Henry |

(Continued)

FOREIGN PATENT DOCUMENTS

| | | | |
|---|---|---|---|
| CA | 2378704 | A1 | 2/2001 |
| CN | 2934555 | Y | 8/2007 |

(Continued)

OTHER PUBLICATIONS

International Search Report and Written Opinion for Int. App. No. PCT/US2014/033742, 8 pages, dated Aug. 27, 2014, from ISA/US Commissioner for Patents.

(Continued)

*Primary Examiner* — Catherine Loikith

(74) *Attorney, Agent, or Firm* — Haynes and Boone, LLP

(57) ABSTRACT

In one aspect, a system includes a tool, a hanger connected to the tool, and a plurality of tubulars connected to the hanger and adapted to be positioned within a wellbore. The tool, hanger, and tubulars are rotatable in response to at least the application of torsion to the tool, and without transferring torque to the connection between the tool and the hanger. In another aspect, a method includes positioning a tubular string within a wellbore, connecting a hanger to the tubular string, and applying torsion to the tubular string to rotate the tubular string. To apply torsion to rotate, a tool is connected to the hanger, and torsion is applied to the tool without transferring torque to the connection between the tool and the hanger. In another aspect, there is provided an apparatus for rotating a tubular string in a preexisting structure, such as a wellbore.

20 Claims, 5 Drawing Sheets

(56) References Cited

U.S. PATENT DOCUMENTS

| | | | |
|---|---|---|---|
| 4,099,745 | A | 7/1978 | Cobbs |
| 4,693,315 | A | 9/1987 | Ringgenberg et al. |
| 4,693,316 | A | 9/1987 | Ringgenberg et al. |
| 5,002,131 | A | 3/1991 | Cromar et al. |
| 5,327,975 | A | 7/1994 | Land |
| 5,551,512 | A | 9/1996 | Smith |
| 5,718,291 | A | 2/1998 | Lorgen et al. |
| 5,794,694 | A | 8/1998 | Smith, Jr. |
| 5,823,264 | A | 10/1998 | Ringgenberg |
| 5,944,111 | A | 8/1999 | Bridges |
| 6,053,262 | A | 4/2000 | Ferguson et al. |
| 6,241,018 | B1 | 6/2001 | Eriksen |
| 6,834,889 | B2 | 12/2004 | Sunde et al. |
| 6,923,256 | B2 | 8/2005 | Parker |
| 7,219,738 | B2 | 5/2007 | Reimert |
| 7,325,610 | B2 | 2/2008 | Giroux et al. |
| 7,360,594 | B2 | 4/2008 | Giroux et al. |
| 7,712,523 | B2 | 5/2010 | Snider et al. |
| 8,069,925 | B2 | 12/2011 | Obrejanu |
| 2005/0022999 | A1 | 2/2005 | Huges |
| 2010/0252252 | A1 | 10/2010 | Harris et al. |
| 2013/0056282 | A1 | 3/2013 | Robottom |

FOREIGN PATENT DOCUMENTS

| | | | |
|---|---|---|---|
| CN | 201236635 | Y | 5/2009 |
| CN | 201460764 | U | 5/2010 |
| CN | 201802321 | U | 4/2011 |
| CN | 202140034 | U | 2/2012 |
| EP | 0624709 | A2 | 11/1994 |
| GB | 846332 | | 8/1960 |
| GB | 2376249 | A | 12/2002 |
| GB | 2381806 | A | 5/2003 |
| RU | 2061833 | C1 | 6/1996 |

OTHER PUBLICATIONS

Office Action dated Jun. 14, 2016 in U.S. Appl. No. 14/250,111 (9 pages).

Notice of Allowance dated Nov. 9, 2016 in U.S. Appl. No. 14/250,111 (5 pages).

SYSTEM AND METHOD FOR ROTATING CASING STRING

CROSS-REFERENCE TO RELATED APPLICATION

This application is a continuation of U.S. patent application Ser. No. 14/250,111, filed Apr. 10, 2014, which claims the benefit of the filing date of, and priority to, U.S. patent application No. 61/811,523, filed Apr. 12, 2013, the entire disclosures of which are hereby incorporated herein by reference.

TECHNICAL FIELD

This disclosure relates in general to a tubular string such as casing string, and in particular to a system and method for rotating casing string.

BACKGROUND OF THE DISCLOSURE

In the oil and gas industry, advances in horizontal drilling have allowed drillers to drill extended reach horizontal sections of wellbores. In some cases, during the installation of a casing string into such an extended reach horizontal section, the casing string needs to be rotated to allow the casing string to be installed to the desired depth. However, rotating the casing string sometimes requires the application of torsion to the casing string using a tool. Such an application of torsion may increase the amount of torque retained in one or more connections between different components of the casing installation system. Additionally, after the torsion has been applied, attempting to disconnect the tool from the casing installation system may increase the risk of breaking connections between tubulars in the casing string. Therefore, what is needed is a system, apparatus or method that addresses one or more of the foregoing issues, or one or more other issues.

SUMMARY

In a first aspect, there is provided a system that includes a tool, a hanger connected to the tool, and a plurality of tubulars connected to the hanger and adapted to be positioned within a wellbore that traverses a subterranean formation. Each of the tubulars is connected to at least one other tubular. The tool, the hanger, and the plurality of tubulars, are rotatable in response to at least the application of torsion to the tool. The tool, the hanger, and the plurality of tubulars, are rotatable without transferring torque to the connection between the tool and the hanger.

In an exemplary embodiment, the hanger is a casing hanger, and the plurality of tubulars is a casing string.

In another exemplary embodiment, the tool, the hanger, and the plurality of tubulars, rotate in response to at least: the application of a tensile load across the tool; and the application of torsion to the tool during the application of the tensile load across the tool.

In certain exemplary embodiments, any trapped torsion between any of the respective connections between any two of the tubulars in the plurality of tubulars is released in response to the application of a compressive load across the tool.

In an exemplary embodiment, after the application of torsion to the tool, the connection between the tool and the hanger is capable of being broken without breaking any of the respective connections between any two of the tubulars in the plurality of tubulars.

In a second aspect, there is provided a method that includes positioning a tubular string within a wellbore that traverses a subterranean formation, the tubular string including a plurality of tubulars, each of the tubulars being connected to at least one other tubular. A hanger is connected to the tubular string. Torsion is applied to the tubular string to rotate the tubular string. To apply torsion to rotate the tubular string, a tool is connected to the hanger, and torsion is applied to the tool, in order to apply torsion to the hanger and thus to the tubular string, without transferring torque to the connection between the tool and the hanger.

In an exemplary embodiment, the tubular string is a casing string, and the hanger is a casing hanger.

In another exemplary embodiment, the tool includes a tubular member, and connecting the tool to the hanger includes connecting the tubular member to the hanger. Torsion is applied to the tool, in order to apply torsion to the hanger and thus to the tubular string, without transferring torque to the connection between the tubular member and the hanger.

In certain exemplary embodiments, the method includes applying a compressive load across the tool to release any trapped torsion between any of the respective connections between any two of the tubulars in the tubular string.

In an exemplary embodiment, the method includes breaking the connection between the tool and the hanger without breaking any of the respective connections between any two of the tubulars in the tubular string.

In another exemplary embodiment, applying torsion to the tubular string further includes applying a tensile load across the tool. Torsion is applied to the tool, in order to apply torsion to the hanger and thus to the tubular string, during applying the tensile load across the tool.

In a third aspect, there is provided an apparatus for rotating a tubular string within a preexisting structure. The apparatus includes a first tubular member, a second tubular member extending within the first tubular member, a third tubular member extending within the first tubular member. The apparatus includes a first configuration in which: the third tubular member is in a first position relative to each of the first and second tubular members; torque is permitted to be transmitted between the second and third tubular members to connect the apparatus to, or disconnect the apparatus from, a fourth tubular member adapted to be connected to the tubular string; and torque is not permitted to be transmitted between the first and third tubular members. The apparatus includes a second configuration in which: the third tubular member is in a second position relative to each of the first and second tubular members; torque is not permitted to be transmitted between the second and third tubular members; and torque is permitted be transmitted between the first and third tubular members to rotate the tubular string.

In an exemplary embodiment, the preexisting structure is a wellbore that traverses a subterranean formation, the fourth tubular member is a casing hanger, and the tubular string is a casing string.

In another exemplary embodiment, the apparatus includes a torsion nut connected to the first tubular member, and the third tubular member extends through the torsion nut. When the apparatus is in the second configuration, torque is permitted to be transmitted between the first and third tubular members via at least the torsion nut.

In certain exemplary embodiments, the third tubular member includes a first plurality of keys or slots, and a second plurality of keys or slots axially spaced from the first plurality of keys or slots.

In an exemplary embodiment, the second tubular member includes a third plurality of keys or slots for complementary engagement with the first plurality of keys or slots when the apparatus is in the first configuration. The torsion nut includes a fourth plurality of keys or slots for complementary engagement with the second plurality of keys or slots when the apparatus is in the second configuration.

In another exemplary embodiment, the apparatus includes a torsion nut connected to one end of the first tubular member, wherein the third tubular member extends through the torsion nut. The first tubular member includes a fifth plurality of keys or slots at the other end thereof for transmitting torque to the tubular string to rotate the tubular string.

In certain exemplary embodiments, the apparatus includes the fourth tubular member, the fourth tubular member including a sixth plurality of keys or slots adapted to complementarily engage the fifth plurality of keys or slots of the first tubular member. When the fourth tubular member is connected to the tubular string, torque is adapted to be transmitted to the tubular string via the fourth tubular member.

In an exemplary embodiment, the apparatus includes a first annular groove formed in the outside surface of the third tubular member, wherein the first annular groove is generally aligned with an end of the torsion nut when the apparatus is in the first configuration, and a second annular groove formed in the outside surface of the third tubular member and axially spaced from the first annular groove, wherein the second annular groove is generally aligned with the end of the torsion nut when the apparatus is in the second configuration.

In another exemplary embodiment, the first and second tubular members include internal and external shoulders, respectively. The apparatus further includes an annular support that is sandwiched between the external shoulder of the second tubular member and the internal shoulder of the first tubular member when the apparatus is in the first configuration.

Other aspects, features, and advantages will become apparent from the following detailed description when taken in conjunction with the accompanying drawings, which are a part of this disclosure and which illustrate, by way of example, principles of the inventions disclosed.

DESCRIPTION OF FIGURES

The accompanying drawings facilitate an understanding of the various embodiments.

DETAILED DESCRIPTION

Figure 1:
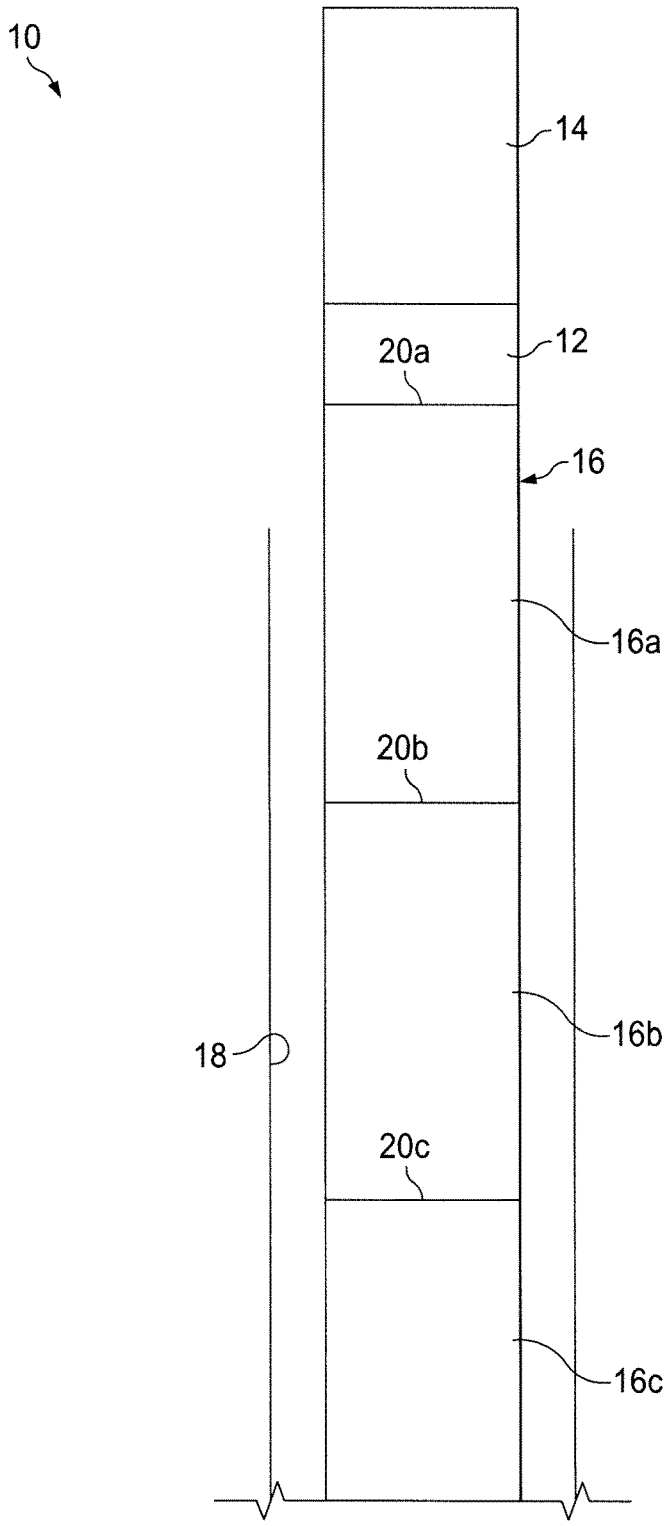
FIG. 1 is a diagrammatic view of an apparatus according to an exemplary embodiment, the apparatus including a tool, a casing hanger and a tubular string.

In an exemplary embodiment, as illustrated in FIG. 1, an apparatus is generally referred to by the reference numeral 10 and includes a hanger, such as a casing hanger 12, to which a tool 14 is connected. A tubular string 16 is connected to the casing hanger 12, and is positioned within a preexisting structure such as, for example, a wellbore 18 that traverses one or more subterranean formations. In an exemplary embodiment, the tubular string 16 is a casing string, which extends within the wellbore 18 to facilitate oil and gas exploration and production operations. The tubular string 16 includes a plurality of tubulars, each of which is connected to at least one other tubular in the tubular string 16. For example, as shown in FIG. 1, the plurality of tubulars in the tubular string 16 includes at least tubulars 16*a*, 16*b* and 16*c*. The tubular 16*a* is connected to the casing hanger 12 to define a connection 20*a*, the tubular 16*b* is connected to the tubular 16*a* to define a connection 20*b*, and the tubular 16*c* is connected to the tubular 16*b* to define a connection 20*c*. In an exemplary embodiment, each of the connections 20*a*, 20*b* and 20*c* is a threaded engagement, with the threaded engagement being sufficiently tight so as to render the tubular string 16 operable for its intended purposes within the wellbore 18 (e.g., conveying fluids through the tubular string 16, holding pressure within the tubular string 16, providing structural support to the wellbore 18, one or more other intended purposes, or any combination thereof). In an exemplary embodiment, each of the connections 20*a*, 20*b* and 20*c* is a box and pin connection, with the box and pin connection being sufficiently tight so as to render the tubular string 16 sufficiently operable for its intended purposes within the wellbore 18 (e.g., conveying fluids through the tubular string 16, holding pressure within the tubular string 16, providing structural support to the wellbore 18, one or more other intended purposes, or any combination thereof).

Figure 2:
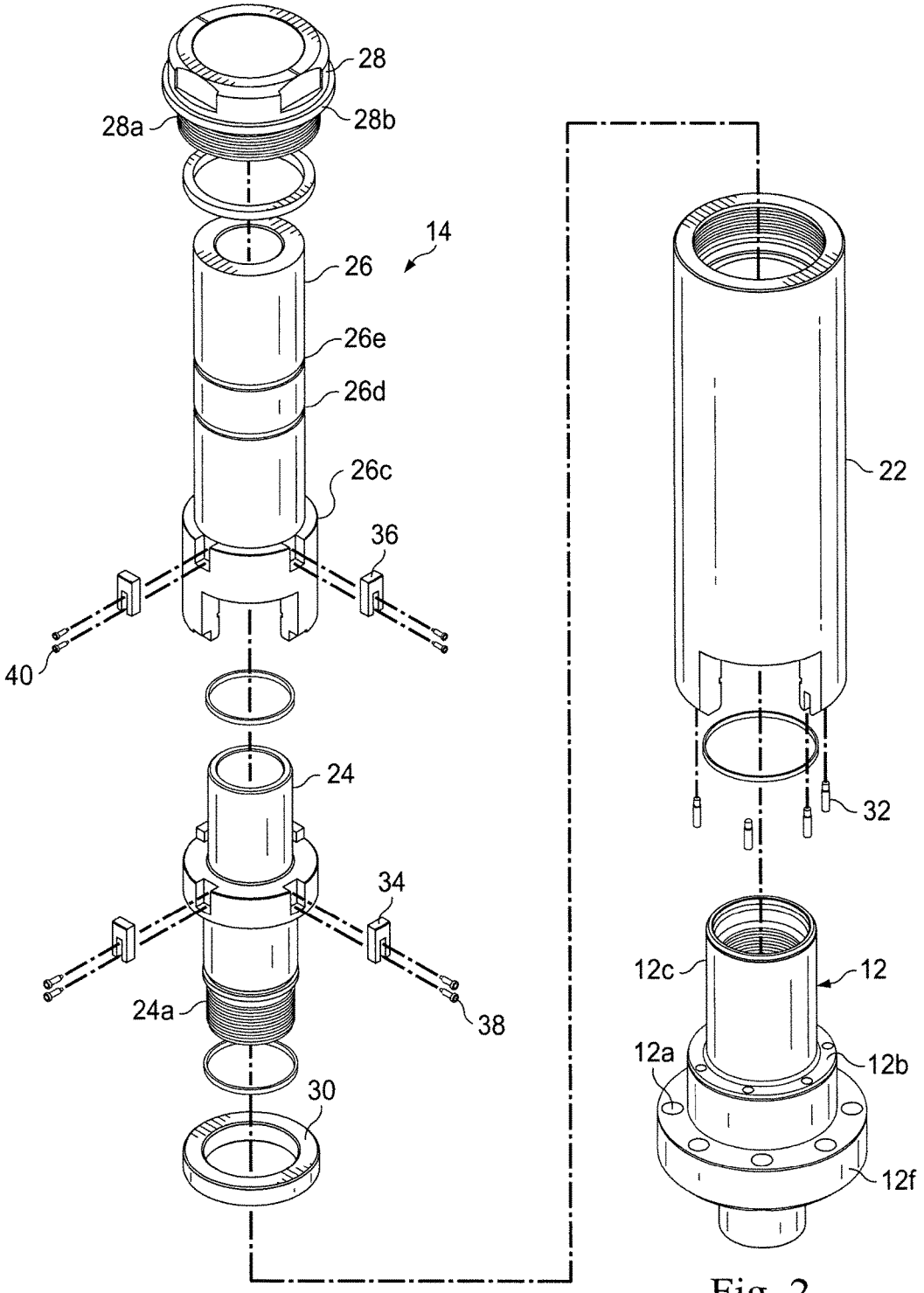
FIG. 2 is an exploded perspective view of the tool and the casing hanger of FIG. 1, according to an exemplary embodiment.

In an exemplary embodiment, as illustrated in FIG. 2 with continuing reference to FIG. 1, the tool 14 includes a first tubular member, such as an outer torsion sleeve (or outer sleeve 22), a second tubular member, such as a casing hanger/running tool connection sleeve (or inner sleeve 24), a third tubular member, such as a landing tool/running tool pup (or pup 26), and a torsion nut 28. The tool 14 further includes an annular support 30, a plurality of torsion keys 32, a plurality of torsion keys 34, and a plurality of torsion keys 36. In an exemplary embodiment, the annular support 30 is a bushing. In an exemplary embodiment, the annular support 30 is a high-capacity axial bearing assembly.

Figure 3:
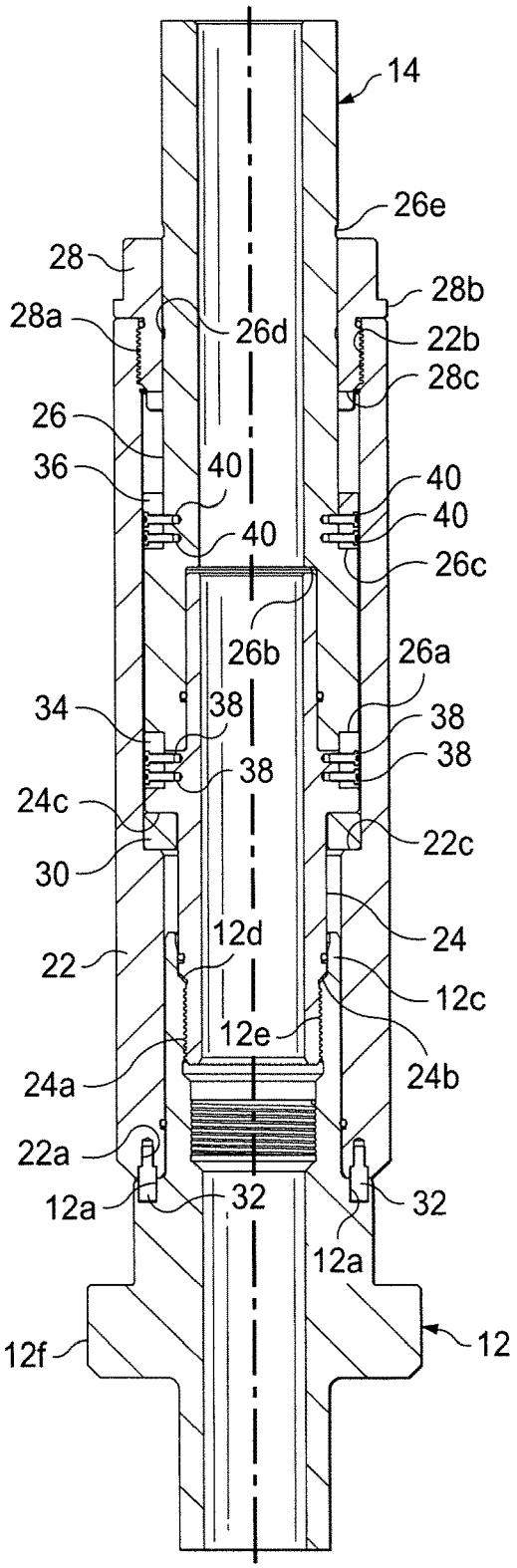
FIG. 3 is a sectional view of the tool and the casing hanger of FIGS. 1 and 2, according to an exemplary embodiment.

In an exemplary embodiment, as illustrated in FIGS. 2 and 3 with continuing reference to FIG. 1, the outer sleeve 22 includes a plurality of openings 22*a* formed in the bottom end thereof; respective internal threaded connections are formed in the openings 22*a*. The torsion keys 32 include respective external threaded connections, which threadably engage with the internal threaded connections in the respective openings 22*a*, thereby connecting the torsion keys 32 to the outer sleeve 22. In an exemplary embodiment, the torsion keys 32 are connected to the outer sleeve 22 using fasteners, or are integrally formed with the outer sleeve 22. The outer sleeve 22 further includes an internal threaded connection 22*b* at the end portion thereof opposing the openings 22*a*, and an internal shoulder 22*c* positioned axially between the openings 22*a* and the internal threaded connection 22*b*.

As shown in FIGS. 2 and 3, and under conditions to be described below, the outer sleeve 22 is adapted to engage the casing hanger 12 so that the torsion keys 32 extend into respective openings 12*a* formed in an external shoulder 12*b* (see FIG. 2) of the casing hanger 12, and so that an upper end portion 12*c* of the casing hanger 12 extends within the outer sleeve 22. An internal shoulder 12*d*, and an internal threaded connection 12*e* adjacent thereto, are formed in the upper end portion 12*c* of the casing hanger 12. The casing hanger 12 further includes a flange 12*f*, which is adapted to engage a wellhead housing (not shown), under conditions to be described below.

The inner sleeve 24 extends within the outer sleeve 22, and includes an external threaded connection 24*a* at the lower end thereof, an external shoulder 24*b* adjacent the external threaded connection 24*a*, and an external shoulder 24*c* above the external shoulder 24*b*. Under conditions to be described below, the external threaded connection 24*a* is adapted to threadably engage, and threadably disengage from, the internal threaded connection 12*e* of the casing hanger 12. Similarly, the external shoulder 24*b* is adapted to engage, and disengage from, the internal shoulder 12*d* of the casing hanger 12, and the external shoulder 24*c* is adapted to engage, and disengage from, the annular support 30. The torsion keys 34 are positioned proximate the external shoulder 24*c*, and are circumferentially spaced around, and connected to, the inner sleeve 24. In an exemplary embodiment, the torsion keys 34 are connected to the inner sleeve 24 via fasteners 38, which extend radially inwardly into the inner sleeve 24. In an exemplary embodiment, the torsion keys 34 are connected to the inner sleeve 24 via other types of fasteners, or are integrally formed with the inner sleeve 24.

The pup 26 extends within the outer sleeve 22, and includes slots 26*a* formed in the lower end thereof, an internal shoulder 26*b*, and an external shoulder 26*c*. Axially-spaced annular grooves 26*d* and 26*e* are formed in the outside surface of the pup 26 proximate the upper end portion thereof. The torsion keys 36 are positioned adjacent the external shoulder 26*c*, and are circumferentially spaced around, and connected to, the pup 26. In an exemplary embodiment, the torsion keys 36 are connected to the pup 26 via fasteners 40, which extend radially inwardly into the pup 26. In an exemplary embodiment, the torsion keys 36 are connected to the pup 26 via other types of fasteners, or are integrally formed with the pup 26. The pup 26 extends through the torsion nut 28, which includes an external threaded connection 28*a*, which is threadably engaged with the internal threaded connection 22*b* of the outer sleeve 22, thereby connecting the torsion nut 28 to the outer sleeve 22. The torsion nut 28 further includes a flange 28*b*, which engages the upper end of the outer sleeve 22. Slots 28*c* are formed in the lower end of the torsion nut 28. In several exemplary embodiments, as indicated in FIGS. 2 and 3, the tool 14 may include annular sealing elements, such as o-rings, which are axially-spaced from one another along the tool 14 and sealingly engage components thereof.

In operation, in an exemplary embodiment, with continuing reference to FIGS. 1, 2 and 3, the apparatus 10 facilitates oil and gas exploration and production operations. More particularly, the flange 12*f* of the casing hanger 12 engages a wellhead housing (not shown), and the tubular string 16 hangs from the casing hanger 12, being positioned within the wellbore 18. In an exemplary embodiment, each of the connections 20*a*, 20*b* and 20*c* is a threaded engagement, with the threaded engagement being sufficiently tight so as to render the tubular string 16 operable for its intended purposes within the wellbore 18 (e.g., conveying fluids through the tubular string 16, holding pressure within the tubular string 16, providing structural support to the wellbore 18, one or more other intended purposes, or any combination thereof). In an exemplary embodiment, the tubular string 16 is in tension at least in part because it hangs from the casing hanger 12. The casing hanger 12 suspends the tubular string 16 within the wellbore 18, thereby causing the tubular string 16 to be in tension. In several exemplary embodiments, at any time during the operation of the apparatus 10, the tool 14 may or may not be connected to the casing hanger 12.

During operation, in several exemplary embodiments, it is desired to rotate the tubular string 16 about its longitudinal axis while the tubular string 16 is in tension and positioned within the wellbore 18. The rotation of the tubular string 16 may be desirable in order to, for example, allow the tubular string 16 to be installed to the desired depth in the subterranean formation(s) through which the wellbore 18 extends. To so rotate the tubular string 16, the tool 14 is connected to the casing hanger 12.

To connect the tool 14 to the casing hanger 12, the tool 14 is assembled in accordance with the foregoing, and then is moved downwards, as viewed in FIG. 3. As a result, the upper end portion 12*c* of the casing hanger 12 extends within the outer sleeve 22, as shown in FIG. 3. The inner sleeve 24 is moved downward within the outer sleeve 22, as viewed in FIG. 3, so that the external threaded connection 24*a* may be threadably engaged with the internal threaded connection 12*e* of the casing hanger 12. The inner sleeve 24 may be so moved by moving the pup 26 downward, as viewed in FIG. 3, so that the torsion keys 34 extend into the respective slots 26*a* of the pup 26. The pup 26 may be rotated, which rotation, due to the extension of the torsion keys 34 into the respective slots 26*a*, transmits torque from the pup 26 to the inner sleeve 24, causing the inner sleeve 24 to rotate and thus the external threaded connection 24*a* to be threadably engaged with the internal threaded connection 12*e*, thereby connecting the inner sleeve 24 to the casing hanger 12. The inner sleeve 24 continues to be rotated until the inner sleeve 24 is sufficiently connected to the casing hanger 12, thereby connecting the tool 14 to the casing hanger 12. At this point, the outer sleeve 22 engages the casing hanger 12 so that the torsion keys 32 complementarily engage, and fully extend into, the respective openings 12*a* of the casing hanger 12. Further, the external shoulders 24*b* and 24*c* engage the internal shoulder 12*d* and the annular support 30, respectively. Still further, the annular support 30 is sandwiched between the external shoulder 24*c* of the inner sleeve 24 and the internal shoulder 22*c* of the outer sleeve 22. Still further, the annular groove 26*e* is generally axially aligned with the upper end of the torsion nut 28, thereby providing an external visual indication that the inner sleeve 24 is sufficiently connected to the casing hanger 12. In the configuration shown in FIG. 3, no tensile load is applied across the tool 14.

Figure 4:
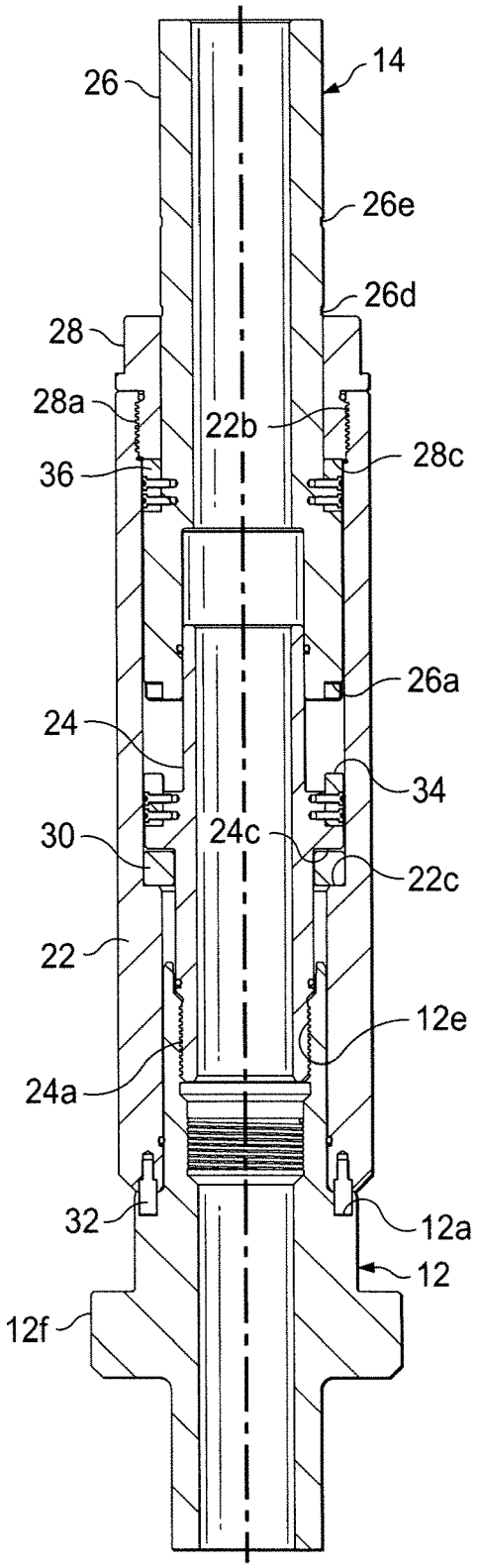
FIG. 4 is a view similar to that of FIG. 3, but depicts the tool in another configuration, according to an exemplary embodiment.

In an exemplary embodiment, as illustrated in FIG. 4 with continuing reference to FIGS. 1, 2 and 3, a tensile load is applied across the tool 14. More particularly, the pup 26 is forced to move upwards, relative to the outer sleeve 22, the inner sleeve 24 and the torsion nut 28, until the torsion keys 36 complementarily engage, and fully extend into, the respective slots 28*c* of the torsion nut 28, as shown in FIG. 4. Thus, the pup 26 shoulders out when the torsion keys 36 are keyed into the respective slots 28*c*. As shown in FIG. 4, the annular groove 26*d* is generally axially aligned with the upper end of the torsion nut 28, thereby providing an external visual indication that the pup 26 has shouldered out against the torsion nut 28, and thus a tensile load is being applied across the tool 14.

The tensile load of the tubular string 16 is transferred from the suspended tubular string 16 to the casing hanger 12 via the connection 20*a* (see FIG. 1), from the casing hanger 12 to the inner sleeve 24 via the threaded engagement between the external threaded connection 24*a* and the internal threaded connection 12*e*, from the inner sleeve 24 to the outer sleeve 22 via the respective engagements between the external shoulder 24*c* and the annular support 30, and between the internal shoulder 22*c* and the annular support 30, from the outer sleeve 22 to the torsion nut 28 via the threaded engagement between the external threaded connection 28*a* and the internal threaded connection 22*b*, and from the torsion nut 28 to the pup 26 via the shouldering out of the pup 26 against the torsion nut 28. In the configuration shown in FIG. 4, the tensile load of the tubular string 16 is applied across the tool 14; as a result, the apparatus 10 is in tension while the tubular string 16 is positioned within the wellbore 18.

After applying the tensile load of the tubular string 16 across the tool 14, torsion is applied to the tubular string 16, while the tubular string 16 is in tension and positioned within the wellbore 18, in order to rotate the tubular string 16 within the wellbore 16. More particularly, when the apparatus 10 is in the configuration shown in FIG. 4 and tension is applied across the tool 14, the pup 16 is rotated about its longitudinal axis, thereby applying torsion to the tool 14. The applied torsion is transmitted from the pup 26 to the torsion nut 28 via extension of the torsion keys 36 into the respective slots 28*c*, from the torsion nut 28 to the outer sleeve 22 via the threaded engagement between the external threaded connection 28*a* and the internal threaded connection 22*b*, from the outer sleeve 22 to the casing hanger 12 via the extension of the torsion keys 32 into the respective openings 12*a*, from the casing hanger 12 to the tubular 16*a* via the connection 20*a* (see FIG. 1), from the tubular 16*a* to the tubular 16*b* via the connection 20*b* (see FIG. 1), from the tubular 16*b* to the tubular 16*c* via the connection 20*c* (see FIG. 1), etc. In response to this applied torsion, the tubular string 16 rotates about its longitudinal axis within the wellbore 18 while remaining in tension. The applied torsion is not transmitted or transferred to the connection between the tool 14 and the casing hanger 12, that is, the threaded engagement between the external threaded connection 24*a* and the internal threaded connection 12*e*.

In several exemplary embodiments, so long as tension is applied across the tool 14 while the tool 14 is connected to the casing hanger 12, the tool 14 is capable of carrying the tensile load of, and rotating, the tubular string 16, without transferring torque to the connection between the tool 14 and the casing hanger 12, that is, the threaded engagement between the external threaded connection 24*a* of the inner sleeve 24 and the internal threaded connection 12*e* of the casing hanger 12. Thus, the amount of torque necessary to disconnect the inner sleeve 24 (and thus the tool 14) from the casing hanger 12 is not increased as a result of applying torsion to the tool 14, the casing hanger 12 and the tubular string 16.

In an exemplary embodiment, when a compressive load is applied across the tool 14, the pup 26 moves downward, as viewed in FIGS. 3 and 4, and un-keys from the torsion nut 28. That is, the torsion keys 36 no longer extend into the respective slots 28*c*, as shown in FIG. 3. As a result, any trapped torsion between any two of the tubulars (e.g., the tubulars 16*a* and 16*b*, or the tubulars 16*b* and 16*c*) in the tubular string 16 is released. Moreover, any trapped torsion between any two of the above-described pairs of components used to transmit or transfer torque from the pup 16 to the tubular 16*c* is released. For example, any trapped torsion in any of the connections 20*a*, 20*b* and 20*c* is released. In an exemplary embodiment, a compressive load may be applied across the tool 14 by forcing the pup 26 to move downward, as viewed in FIG. 3. In an exemplary embodiment, a compressive load may be applied across the tool 14 by permitting the apparatus 10 to be dropped into, or landed in, the wellhead profile, and/or manipulating the apparatus 10 or components thereof so that the apparatus 10 drops into, or lands in, the wellhead profile. The pup 26 continues to move downward until it keys into the inner sleeve 24, that is, the torsion keys 34 complementarily engage, and fully extend into, the respective slots 26*a* of the pup 26, as shown in FIG. 3.

Figure 5:
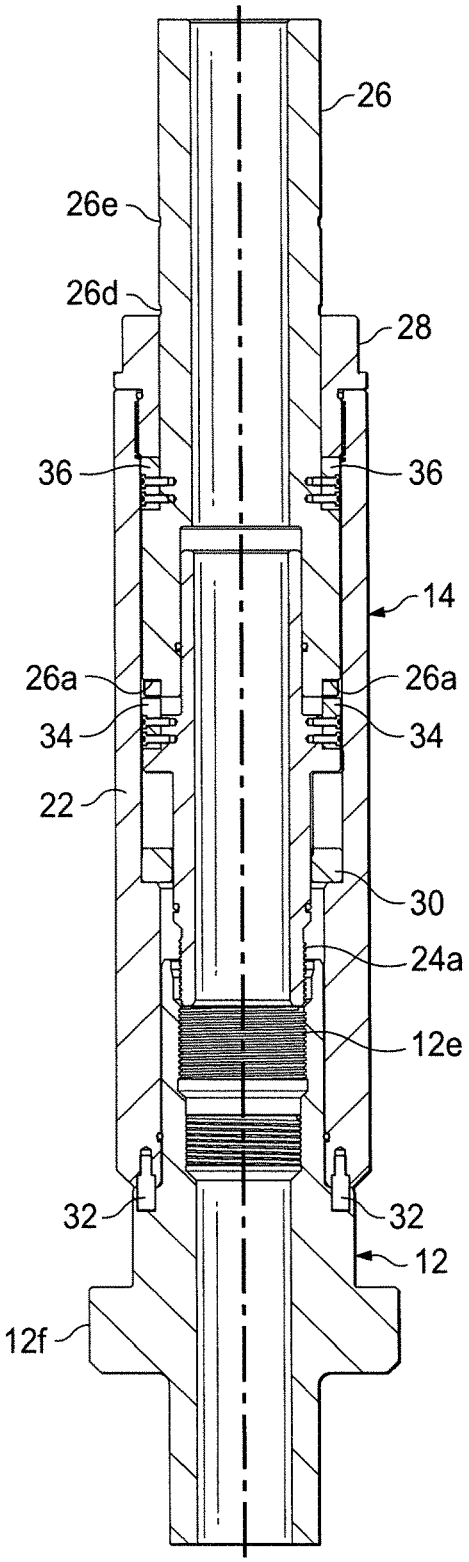
FIG. 5 is a view similar to that of each of FIGS. 3 and 4, but depicts the tool in yet another configuration, according to an exemplary embodiment.

In an exemplary embodiment, as illustrated in FIG. 5 with continuing reference to FIGS. 1, 2, 3 and 4, after the pup 26 has keyed into the inner sleeve 24, the tool 14 may be disconnected from the casing hanger 12. To disconnect the tool 14 from the casing hanger 12, the pup 26 is rotated, which rotation, due to the extension of the torsion keys 34 into the respective slots 26*a*, transmits torque from the pup 26 to the inner sleeve 24, causing the inner sleeve 24 to rotate and thus break the connection between the tool 14 and the casing hanger 12, that is, the threaded engagement between the external threaded connection 24*a* and the internal threaded connection 12*e*. Accordingly, continued rotation of the pup 26 causes the external threaded connection 24*a* to be threadably disengaged from the internal threaded connection 12*e*. As a result, the tool 14 is disconnected from the casing hanger 12. During or after the rotation effecting this disconnection, the pup 26 may be forced upwards until the annular groove 26*d* is generally axially aligned with the upper end of the torsion nut 28, thereby providing an external visual indication that the inner sleeve 24, and thus the tool 14, is fully disconnected from the casing hanger 12. This external visual indication is shown in FIG. 5. Since the tool 14 is disconnected from the casing hanger 12, the tool 14 may be lifted off of the casing hanger 12 so that that the torsion keys 32 no longer extend into the respective openings 12*a* of the casing hanger 12.

During the above-described disconnection of the tool 14 from the casing hanger 12, the connection between the tool 14 and the casing hanger 12 may be broken without breaking the connection 20*a* (see FIG. 1), and without breaking any of the respective connections between any two of the tubulars in the tubular string 16, such as the connection 20*b* or 20*c* (see FIG. 1). This is possible because the tool 14 permitted torsion to be applied to the tubular string 16, in order to rotate the tubular string 16 within the wellbore 18 as described above, without transferring torque to the connection between the tool 14 and the casing hanger 12. In several exemplary embodiments, use of the tool 14 to rotate the tubular string 16 eliminates, or at least reduces, the risk that the connection 20*b* or 20*c*, or any other connections between any two tubulars in the tubular string 16, may be broken before the connection between the tool 14 and the casing hanger 12 is broken. As a result, all connections between the tubulars in the tubular string 16 (including the connections 20*b* and 20*c*), and the connection 20*a*, remain sufficiently tight so as to render the tubular string 16 operable for its intended purposes within the wellbore 18 (e.g., conveying fluids through the tubular string 16, holding pressure within the tubular string 16, providing structural support to the wellbore 18, one or more other intended purposes, or any combination thereof).

In several exemplary embodiments, the tubular member, to which the tool 14 is adapted to be connected, may not be a casing hanger; instead of the casing hanger 12, the tool 14 may be connected to another type of hanger, or another tubular member, in a manner similar to the manner in which the tool 14 is connected to the casing hanger 12. In several exemplary embodiments, the tubular member substituted for the casing hanger 12, as well as the tool 14, may be positioned anywhere along the tubular string 16, and may be characterized as part of the tubular string 16. Since the tool 14 is part of the tubular string 16, the tool 14 is operable to, for example, convey fluids through the tubular string 16, hold pressure within the tubular string 16, provide structural support to the wellbore 18, or any combination thereof. Alternatively, in several exemplary embodiments, the tubular member substituted for the casing hanger 12, as well as the tool 14, may be positioned inline between the tubular string 16 and another tubular string, or may define a portion of the tubular string 16 upstream of the tool 14 and another portion of the tubular string 16 downstream of the tubular member substituted for the casing hanger 12. Since the tool 14 is positioned inline between the tubular string 16 and another tubular string, or defines upstream and downstream portions of the tubular string 16, the tool 14 is operable to, for example, convey fluids through the tubular string 16, hold pressure within the tubular string 16, provide structural support to the wellbore 18, or any combination thereof.

In several exemplary embodiments, the tool 14 enables a customer to rotate the tubular string 16 while installing it in the wellbore 18. This helps to reduce the risk of the tubular string 16 (such as casing string) getting stuck during installation. This also allows the customer to install the tubular string 16 (such as casing string) into long horizontal wellbore sections. In several exemplary embodiments, after the mandrel casing hanger has been landed in the wellhead profile and the tool 14 is in compression, the connection between the tool 14 and the casing hanger 12 is the lowest torqued connection in the entire tubular string 16. When, for example, a left hand torque is applied to the entire tubular string 16, the tool 14 will start to back off from the casing hanger 12 and allow for the tool 14 to be removed from the wellbore 18. In several exemplary embodiments, the operation of the apparatus 10, including the rotation of the tubular string 16, does not increase the amount of torque retained in the respective connections between adjacent tubulars in the tubular string 16. Moreover, in several exemplary embodiments, disconnecting the tool 14 from the casing hanger 12 (or from another tubular member) does not increase the risk of breaking any of the respective connections between adjacent tubulars in the tubular string 16.

In the foregoing description of certain embodiments, specific terminology has been resorted to for the sake of clarity. However, the disclosure is not intended to be limited to the specific terms so selected, and it is to be understood that each specific term includes other technical equivalents which operate in a similar manner to accomplish a similar technical purpose. Terms such as "left" and right", "front" and "rear", "above" and "below" and the like are used as words of convenience to provide reference points and are not to be construed as limiting terms.

In this specification, the word "comprising" is to be understood in its "open" sense, that is, in the sense of "including", and thus not limited to its "closed" sense, that is the sense of "consisting only of". A corresponding meaning is to be attributed to the corresponding words "comprise", "comprised" and "comprises" where they appear.

In addition, the foregoing describes only some embodiments of the invention(s), and alterations, modifications, additions and/or changes can be made thereto without departing from the scope and spirit of the disclosed embodiments, the embodiments being illustrative and not restrictive.

Furthermore, invention(s) have described in connection with what are presently considered to be the most practical and preferred embodiments, it is to be understood that the invention is not to be limited to the disclosed embodiments, but on the contrary, is intended to cover various modifications and equivalent arrangements included within the spirit and scope of the invention(s). Also, the various embodiments described above may be implemented in conjunction with other embodiments, e.g., aspects of one embodiment may be combined with aspects of another embodiment to realize yet other embodiments. Further, each independent feature or component of any given assembly may constitute an additional embodiment.

What is claimed is:

1. A system, comprising:

a tool;

a hanger connected to the tool; and a plurality of tubulars connected to the hanger and adapted to be positioned within a wellbore that traverses a subterranean formation, each of the tubulars being connected to at least one other tubular;

wherein applying a tensile load across the tool causes the tool, the hanger, and the plurality of tubulars to be together rotatable, without transferring torque to the connection between the tool and the hanger, in response to an application of torsion to the tool; and wherein applying a compressive load across the tool prevents the tool, the hanger, and the plurality of tubulars from being together rotatable without transferring torque to the connection between the tool and the hanger.

2. The system of claim 1, wherein the hanger is a casing hanger; and wherein the plurality of tubulars is a casing string.

3. The system of claim 1, wherein the tool, the hanger, and the plurality of tubulars rotate in response to at least:

an application of the tensile load across the tool; and the application of torsion to the tool during the application of the tensile load across the tool.

4. The system of claim 1, wherein any trapped torsion between any of the respective connections between any two of the tubulars in the plurality of tubulars is released in response to an application of the compressive load across the tool.

5. The system of claim 1, wherein, after the application of torsion to the tool, the connection between the tool and the hanger is capable of being broken without breaking any of the respective connections between any two of the tubulars in the plurality of tubulars.

6. A system, comprising:

a tool adapted to be connected to a hanger to which a plurality of tubulars are adapted to be connected;

wherein the tool is configured so that, when the plurality of tubulars are connected to the hanger and the tool is connected to the hanger to which the plurality of tubulars are connected, applying a tensile load across the tool causes the tool, the hanger, and the plurality of tubulars to be together rotatable, without transferring torque to the connection between the tool and the hanger, in response to an application of torsion to the tool;

and wherein the tool is configured so that, when the plurality of tubulars are connected to the hanger and the tool is connected to the hanger to which the plurality of tubulars are connected, applying a compressive load across the tool prevents the tool, the hanger, and the plurality of tubulars from being together rotatable without transferring torque to the connection between the tool and the hanger.

7. The system of claim 6, wherein the hanger is a casing hanger; and wherein the plurality of tubulars is a casing string.

8. The system of claim 6, wherein the tool is configured so that, when the plurality of tubulars are connected to the hanger and the tool is connected to the hanger to which the plurality of tubulars are connected, the tool, the hanger, and the plurality of tubulars rotate in response to at least:

an application of the tensile load across the tool; and the application of torsion to the tool during the application of the tensile load across the tool.

9. The system of claim 6, wherein the tool is configured so that, when the plurality of tubulars are connected to the hanger and the tool is connected to the hanger to which the plurality of tubulars are connected, any trapped torsion between any connection between any two of the tubulars in the plurality of tubulars is released in response to an application of the compressive load across the tool.

10. The system of claim 6, wherein the tool is configured so that, when the plurality of tubulars are connected to the hanger and the tool is connected to the hanger to which the plurality of tubulars are connected, and after the application of torsion to the tool, the connection between the tool and the hanger is capable of being broken without breaking any connection between any two of the tubulars in the plurality of tubulars.

11. The system of claim 6, further comprising the hanger, which is connected to the tool.

12. The system of claim 11, wherein the hanger is a casing hanger.

13. The system of claim 11, further comprising the plurality of tubulars connected to the hanger, each of the tubulars in the plurality of tubulars being connected to at least one other tubular in the plurality of tubulars.

14. The system of claim 13, wherein the hanger is a casing hanger; and wherein the plurality of tubulars is a casing string.

15. A method, comprising:

positioning a tubular string within a wellbore that traverses a subterranean formation, the tubular string comprising a plurality of tubulars, each of the tubulars being connected to at least one other tubular;

connecting a hanger to the tubular string; and applying torsion to the tubular string to rotate the tubular string within the wellbore, comprising:

connecting a tool to the hanger;

applying a tensile load across the tool; and during the application of the tensile load across the tool, applying torsion to the tool in order to apply torsion to the hanger and thus to the tubular string so that the tool, the hanger, and the plurality of tubulars rotate together without transferring torque to the connection between the tool and the hanger;

wherein applying a compressive load across the tool prevents the tool, the hanger, and the plurality of tubulars from being together rotatable without transferring torque to the connection between the tool and the hanger.

16. The method of claim 15, wherein the tubular string is a casing string;

and wherein the hanger is a casing hanger.

17. The method of claim 15, wherein the tool comprises a tubular member; and wherein connecting the tool to the hanger comprises connecting the tubular member to the hanger; and wherein torsion is applied to the tubular member, in order to apply torsion to the hanger and thus to the tubular string, without transferring torque to the connection between the tubular member and the hanger.

18. The method of claim 15, further comprising applying the compressive load across the tool to release any trapped torsion between any of the respective connections between any two of the tubulars in the tubular string.

19. The method of claim 15, further comprising breaking the connection between the tool and the hanger without breaking any of the respective connections between any two of the tubulars in the tubular string.

20. The method of claim 15, wherein the torsion is applied to the tool in order to apply torsion to the hanger and thus to the tubular string during the application of the tensile load across the tool.

* * * * *